US011645982B2

(12) United States Patent
Kim et al.

(10) Patent No.: US 11,645,982 B2
(45) Date of Patent: May 9, 2023

(54) DISPLAY DEVICE AND METHOD FOR PROCESSING COMPENSATION DATA THEREOF

(71) Applicant: LG DISPLAY CO., LTD., Seoul (KR)

(72) Inventors: Jihwan Kim, Seoul (KR); Sunwoo Kwun, Incheon (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 17/881,161

(22) Filed: Aug. 4, 2022

(65) Prior Publication Data

US 2023/0082051 A1 Mar. 16, 2023

(30) Foreign Application Priority Data

Sep. 16, 2021 (KR) ..... 10-2021-0124329

(51) Int. Cl.
*G09G 3/3275* (2016.01)
*G09G 3/3233* (2016.01)

(52) U.S. Cl.
CPC ..... *G09G 3/3275* (2013.01); *G09G 3/3233* (2013.01); *G09G 2300/0842* (2013.01); *G09G 2320/0233* (2013.01); *G09G 2320/043* (2013.01); *G09G 2340/02* (2013.01); *G09G 2360/16* (2013.01)

(58) Field of Classification Search
CPC ..... G09G 3/3233; G09G 3/3275; G09G 2300/0842
See application file for complete search history.

(56) References Cited

U.S. PATENT DOCUMENTS

2021/0241496 A1* 8/2021 Pesonen ..... G06T 5/00

FOREIGN PATENT DOCUMENTS

JP 2020522946 * 7/2020 ..... G09G 3/2096

* cited by examiner

*Primary Examiner* — Nelson M Rosario
*Assistant Examiner* — Scott D Au
(74) *Attorney, Agent, or Firm* — Morgan, Lewis & Bockius LLP

(57) ABSTRACT

For a display device having a plurality of subpixels disposed in an active area of a display panel, a method for processing a compensation data of the display device may include reconfiguring an order of unit patches having the compensation data so that the unit patches having similar reference values are positioned adjacent to each other when the compensation data are compressed. The disclosed method can improve the compression process efficiency where a compression loss can be reduced, and an effect of an image quality improvement using the compensation data can be enhanced.

14 Claims, 12 Drawing Sheets

*Compensation data* *Compensation data blurring-processed*

DISPLAY DEVICE AND METHOD FOR PROCESSING COMPENSATION DATA THEREOF

CROSS REFERENCE TO RELATED APPLICATION

This application claims the benefit of and priority to Korea Patent Application No. 10-2021-0124329, filed on Sep. 16, 2021, the entirety of which is incorporated herein by reference for all purposes.

BACKGROUND

1. Technical Field

The present disclosure relates to devices and methods and particularly to, for example, without limitation, a display device and a method for processing a compensation data of the display device.

2. Discussion of the Related Art

The growth of the information society leads to increased demand for display devices to display images and use of various types of display devices, such as liquid crystal display devices, organic light emitting display devices, and other types of display devices.

The display device may include a display panel for displaying an image and various circuits for driving the display panel. The display panel may include a plurality of subpixels and may display an image having a luminance produced by the plurality of subpixels.

The luminance of the subpixels, however, may vary due to a variation in characteristics among the subpixels. This may in turn degrade the image quality.

The description provided in the discussion of the related art section should not be assumed to be prior art merely because it is mentioned in or associated with that section. The discussion of the related art section may include information that describes one or more aspects of the subject technology.

SUMMARY

The inventors of the present disclosure have recognized the problems and disadvantages of the related art and have performed extensive research and experiments. The inventors of the present disclosure have thus invented a new display device and a new method for processing a compensation data of the display device that substantially obviate one or more problems due to limitations and disadvantages of the related art.

In one or more aspects, embodiments of the present disclosure may provide methods of preventing degradation of an image quality that may occur due to the characteristic variation (or deviation) among subpixels and efficiently processing a compensation data to reduce the luminance variation (or deviation) caused by the characteristic variation.

In one or more aspects, embodiments of the present disclosure may provide a method for processing a compensation data of a display device including generating a compensation data for a plurality of subpixels disposed in an active area of a display panel, extracting two or more unit patches from the active area, calculating a reference value of each of the two or more unit patches using the compensation data included in each of the two or more unit patches, reconfiguring an order of the two or more unit patches based on the reference value, and compressing the compensation data included in the two or more unit patches disposed according to an order which is reconfigured.

In one or more aspects, embodiments of the present disclosure may provide a display device including a plurality of subpixels disposed in an active area of a display panel, a data driving circuit configured to drive the plurality of subpixels, and a controller configured to control the data driving circuit and store a compensation data for the plurality of subpixels, wherein the controller may be configured to cause: storing the compensation data by extracting two or more unit patches from the active area; reconfiguring an order of the two or more unit patches according to a reference value calculated by using the compensation data included in each of the two or more unit patches; and compressing the compensation data included in the two or more unit patches disposed according to the reconfigured order.

According to various embodiments of the present disclosure, methods may be provided for reducing a compression loss of a compensation data by an efficient process of the compensation data and effectively preventing degradation of an image quality that may occur due to the characteristic deviation among subpixels.

Additional features, advantages, and aspects of the present disclosure are set forth in part in the description that follows and in part will become apparent from the present disclosure or may be learned by practice of the inventive concepts provided herein. Other features, advantages, and aspects of the present disclosure may be realized and attained by the descriptions provided in the present disclosure, or derivable therefrom, and the claims hereof as well as the appended drawings. It is intended that all such features, advantages, and aspects be included within this description, be within the scope of the present disclosure, and be protected by the following claims. Nothing in this section should be taken as a limitation on those claims. Further aspects and advantages are discussed below in conjunction with embodiments of the disclosure.

It is to be understood that both the foregoing description and the following description of the present disclosure are exemplary and explanatory, and are intended to provide further explanation of the disclosure as claimed

BRIEF DESCRIPTION OF THE DRAWINGS

The accompanying drawings, which are included to provide a further understanding of the disclosure, are incorporated in and constitute a part of this disclosure, illustrate embodiments of the disclosure, and together with the description serve to explain principles of the disclosure. In the drawings.

Figure 1:
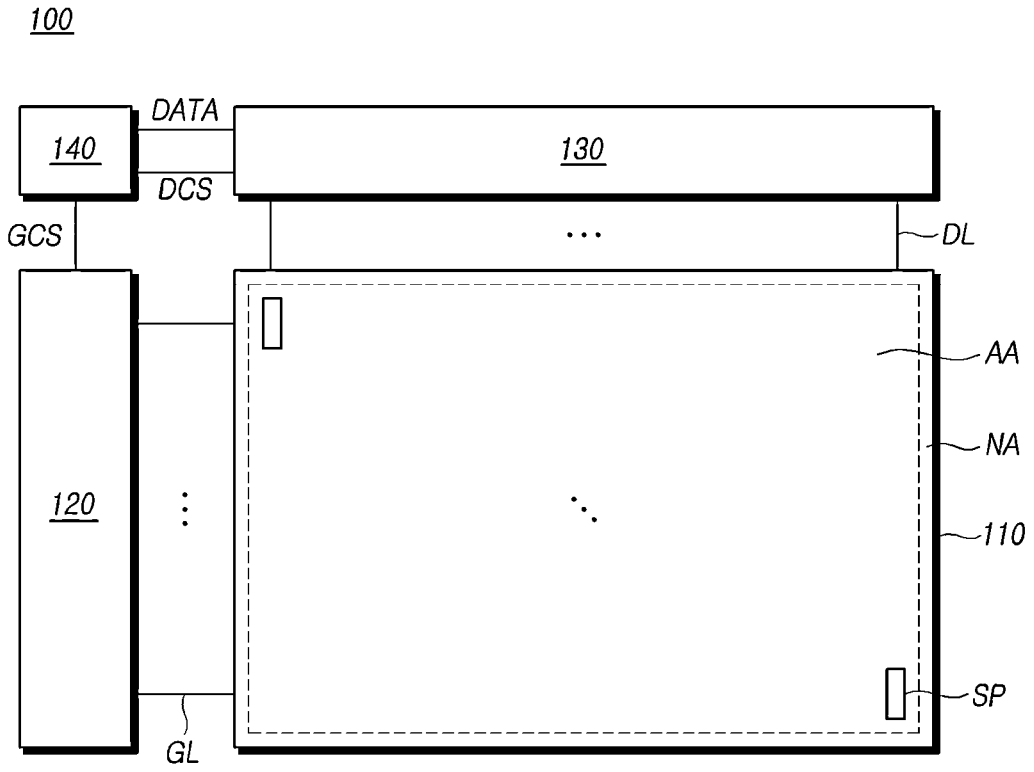
FIG. 1 is a diagram schematically illustrating a configuration of a display device according to example embodiments of the present disclosure.

Throughout the drawings and the detailed description, unless otherwise described, the same drawing reference numerals should be understood to refer to the same elements, features, and structures. The relative size and depiction of these elements may be exaggerated for clarity, illustration, and convenience.

DETAILED DESCRIPTION

Reference is now made in detail to embodiments of the present disclosure, examples of which may be illustrated in the accompanying drawings. In the following description, when a detailed description of well-known functions or configurations may unnecessarily obscure aspects of the present disclosure, the detailed description thereof may be omitted. The progression of processing steps and/or operations described is an example; however, the sequence of steps and/or operations is not limited to that set forth herein and may be changed, with the exception of steps and/or operations necessarily occurring in a particular order.

Unless stated otherwise, like reference numerals refer to like elements throughout even when they are shown in different drawings. In one or more aspects, identical elements (or elements with identical names) in different drawings may have the same or substantially the same functions and properties unless stated otherwise. Names of the respective elements used in the following explanations are selected only for convenience and may be thus different from those used in actual products.

Advantages and features of the present disclosure, and implementation methods thereof, are clarified through the embodiments described with reference to the accompanying drawings. The present disclosure may, however, be embodied in different forms and should not be construed as limited to the embodiments set forth herein. Rather, these embodiments are provided so that this disclosure is thorough and complete and fully conveys the scope of the present disclosure to those skilled in the art. Furthermore, the present disclosure is only defined by claims and their equivalents.

The shapes, sizes, areas, ratios, angles, numbers, and the like disclosed in the drawings for describing embodiments of the present disclosure are merely examples, and thus, the present disclosure is not limited to the illustrated details.

When the term "comprise," "have," "include," "contain," "constitute," "make up of," "formed of," or the like is used, one or more other elements may be added unless a term such as "only" or the like is used. The terms used in the present disclosure are merely used in order to describe particular embodiments, and are not intended to limit the scope of the present disclosure. The terms of a singular form may include plural forms unless the context clearly indicates otherwise. The word "exemplary" is used to mean serving as an example or illustration. Any implementation described herein as an "example" is not necessarily to be construed as preferred or advantageous over other implementations.

In one or more aspects, an element, feature, or corresponding information (e.g., a level, range, dimension, size, or the like) is construed as including an error or tolerance range even where no explicit description of such an error or tolerance range is provided. An error or tolerance range may be caused by various factors (e.g., process factors, internal or external impact, noise, or the like). Further, the term "may" fully encompasses all the meanings of the term "can."

In describing a positional relationship, where the positional relationship between two parts is described, for example, using "on," "over," "under," "above," "below," "beneath," "near," "close to," or "adjacent to," "beside," "next to," or the like, one or more other parts may be located between the two parts unless a more limiting term, such as "immediate(ly)," "direct(ly)," or "close(ly)," is used. For example, when a structure is described as being positioned "on," "over," "under," "above," "below," "beneath," "near," "close to," or "adjacent to," "beside," or "next to" another structure, this description should be construed as including a case in which the structures contact each other as well as a case in which one or more additional structures are disposed or interposed therebetween. Furthermore, the terms "front," "rear," "back," "left," "right," "top," "bottom," "downward," "upward," "upper," "lower," "up," "down," "column," "row," "vertical," "horizontal," and the like refer to an arbitrary frame of reference.

In describing a temporal relationship, when the temporal order is described as, for example, "after," "subsequent," "next," "before," "preceding," "prior to," or the like, a case that is not consecutive or not sequential may be included unless a more limiting term, such as "just," "immediate(ly)," or "direct(ly)," is used.

It is understood that, although the term "first," "second," or the like may be used herein to describe various elements, these elements should not be limited by these terms. These terms are only used to distinguish one element from another. For example, a first element could be a second element, and, similarly, a second element could be a first element, without departing from the scope of the present disclosure. Furthermore, the first element, the second element, and the like may be arbitrarily named according to the convenience of those skilled in the art without departing from the scope of the present disclosure. The terms "first," "second," and the like may be used to distinguish components from each other, but the functions or structures of the components are not limited by ordinal numbers or component names in front of the components.

In describing elements of the present disclosure, the terms "first," "second," "A," "B," "(a)," "(b)," or the like may be used. These terms are intended to identify the corresponding element(s) from the other element(s), and these are not used to define the essence, basis, order, or number of the elements.

For the expression that an element or layer is "connected," "coupled," or "adhered" to another element or layer, the element or layer can not only be directly connected, coupled, or adhered to another element or layer, but also be indirectly connected, coupled, or adhered to another element or layer with one or more intervening elements or layers disposed or interposed between the elements or layers, unless otherwise specified.

For the expression that an element or layer "contacts," "overlaps," or the like with another element or layer, the element or layer can not only directly contact, overlap, or the like with another element or layer, but also indirectly contact, overlap, or the like with another element or layer with one or more intervening elements or layers disposed or interposed between the elements or layers, unless otherwise specified.

The term "at least one" should be understood as including any and all combinations of one or more of the associated listed items. For example, the meaning of "at least one of a first item, a second item, and a third item" denotes the combination of items proposed from two or more of the first item, the second item, and the third item as well as only one of the first item, the second item, or the third item.

The expression of a first element, a second elements "and/or" a third element should be understood as one of the first, second and third elements or as any or all combinations of the first, second and third elements. By way of example, A, B and/or C can refer to only A; only B; only C; any or some combination of A, B, and C; or all of A, B, and C.

In one or more aspects, the terms "between" and "among" may be used interchangeably simply for convenience. For example, an expression "between a plurality of elements" may be understood as among a plurality of elements. In another example, an expression "among a plurality of elements" may be understood as between a plurality of elements. In one or more examples, the number of elements may be two. In one or more examples, the number of elements may be more than two.

In one or more aspects, the terms "each other" and "one another" may be used interchangeably simply for convenience. For example, an expression "adjacent to each other" may be understood as being adjacent to one another. In another example, an expression "adjacent to one another" may be understood as being adjacent to each other. In one or more examples, the number of elements involved in the foregoing expression may be two. In one or more examples, the number of elements involved in the foregoing expression may be more than two.

Features of various embodiments of the present disclosure may be partially or wholly coupled to or combined with each other and may be variously inter-operated, linked or driven together. The embodiments of the present disclosure may be carried out independently from each other or may be carried out together in a co-dependent or related relationship. In one or more aspects, the components of each apparatus according to various embodiments of the present disclosure are operatively coupled and configured.

Unless otherwise defined, the terms (including technical and scientific terms) used herein have the same meaning as commonly understood by one of ordinary skill in the art to which example embodiments belong. It is further understood that terms, such as those defined in commonly used dictionaries, should be interpreted as having a meaning that is, for example, consistent with their meaning in the context of the relevant art and should not be interpreted in an idealized or overly formal sense unless expressly defined otherwise herein. For example, the term "part" may apply, for example, to a separate circuit or structure, an integrated circuit, a computational block of a circuit device, or any structure configured to perform a described function as should be understood by one of ordinary skill in the art.

Hereinafter, various example embodiments of the present disclosure are described in detail with reference to the accompanying drawings. For convenience of description, a scale, dimension, size, and thickness of each of the elements illustrated in the accompanying drawings may differ from an actual scale, dimension, size, and thickness, and thus, embodiments of the present disclosure are not limited to a scale, dimension, size, and thickness illustrated in the drawings.

FIG. 1 is a diagram schematically illustrating a configuration of a display device 100 according to example embodiments of the present disclosure. All the components of the display device 100 according to all embodiments of the present disclosure are operatively coupled and configured.

Referring to FIG. 1, the display device 100 may include a display panel 110, and a gate driving circuit 120, a data driving circuit 130 and a controller 140 for driving the display panel 110.

The display panel 110 may include an active area AA where a plurality of subpixels SP is disposed, and a non-active area NA which is located outside the active area AA.

A plurality of gate lines GL and a plurality of data lines DL may be arranged on the display panel 110. The plurality of subpixels SP may be located in areas where the gate lines GL and the data lines DL intersect each other.

The gate driving circuit 120 may be controlled by the controller 140, and sequentially output scan signals to the plurality of gate lines GL arranged on the display panel 110, thereby controlling the driving timing of the plurality of subpixels SP.

The gate driving circuit 120 may include one or more gate driver integrated circuits GDIC, and may be located only at one side of the display panel 110, or may be located at both sides thereof according to a driving method.

Each gate driver integrated circuit GDIC may be connected to a bonding pad of the display panel 110 by a tape automated bonding TAB method or a chip-on-glass COG method. Alternatively, each gate drive integrated circuit GDIC may be implemented by a gate-in-panel GIP method to then be directly arranged on the display panel 110. Alternatively, the gate driver integrated circuit GDIC may be integrated and arranged on the display panel 110. Alternatively, each gate driver integrated circuit GDIC may be implemented by a chip-on-film COF method in which an element is mounted on a film connected to the display panel 110.

The data driving circuit 130 may receive image data from the controller 140 and convert the image data into an analog data voltage Vdata. Then, the data driving circuit 130 may output the data voltage Vdata to each data line DL according to the timing at which the scan signal is applied through the gate line GL so that each of the plurality of subpixels SP emits light having brightness according to the image data.

The data driving circuit 130 may include one or more source driver integrated circuits SDIC.

Each source driver integrated circuit SDIC may include a shift register, a latch circuit, a digital-to-analog converter, an output buffer, and the like.

Each source driver integrated circuit SDIC may be connected to a bonding pad of the display panel 110 by a tape automated bonding TAB method or a chip-on-glass COG method. Alternatively, each source driver integrated circuit SDIC may be directly disposed on the display panel 110. Alternatively, the source driver integrated circuit SDIC may be integrated and arranged on the display panel 110. Alternatively, each source driver integrated circuit SDIC may be implemented by a chip-on-film COF method. In this case, each source driver integrated circuit SDIC may be mounted on a film connected to the display panel 110, and may be electrically connected to the display panel 110 through wires on the film.

The controller 140 may supply various control signals to the gate driving circuit 120 and the data driving circuit 130, and may control the operation of the gate driving circuit 120 and the data driving circuit 130.

The controller 140 may be mounted on a printed circuit board, a flexible printed circuit, or the like, and may be electrically connected to the gate driving circuit 120 and the data driving circuit 130 through the printed circuit board, the flexible printed circuit, or the like.

The controller 140 may allow the gate driving circuit 120 to output a scan signal according to the timing implemented in each frame. The controller 140 may convert a data signal received from the outside to conform to the data signal format used in the data driving circuit 130 and then output the converted image data to the data driving circuit 130.

The controller 140 may receive, from the outside (e.g., a host system), various timing signals including a vertical synchronization signal VSYNC, a horizontal synchronization signal HSYNC, an input data enable DE signal, a clock signal CLK, and the like, as well as the image data.

The controller 140 may generate various control signals using various timing signals received from the outside, and may output the control signals to the gate driving circuit 120 and the data driving circuit 130.

For example, in order to control the gate driving circuit 120, the controller 140 may output various gate control signals GCS including a gate start pulse GSP, a gate shift clock GSC, a gate output enable signal GOE, or the like.

The gate start pulse GSP may control the operation start timing of one or more gate driver integrated circuits GDIC constituting the gate driving circuit 120. The gate shift clock GSC, which is a clock signal commonly input to one or more gate driver integrated circuits GDIC, may control the shift timing of a scan signal. The gate output enable signal GOE may specify the timing information on one or more gate driver integrated circuits GDIC.

In addition, in order to control the data driving circuit 130, the controller 140 may output various data control signals DCS including a source start pulse SSP, a source sampling clock SSC, a source output enable signal SOE, or the like.

The source start pulse SSP may control a data sampling start timing of one or more source driver integrated circuits SDIC constituting the data driving circuit 130. The source sampling clock SSC may be a clock signal for controlling the timing of sampling data in the respective source driver integrated circuits SDIC. The source output enable signal SOE may control the output timing of the data driving circuit 130.

The display device 100 may further include a power management integrated circuit for supplying various voltages or currents to the display panel 110, the gate driving circuit 120, the data driving circuit 130, and the like or controlling various voltages or currents to be supplied thereto.

Each subpixels SP may be an area defined by a cross of the gate line GL and the data line DL, and at least one circuit element including a light-emitting element may be disposed in a subpixel SP.

For example, in the case that the display device 100 is an organic light-emitting display device, an organic light-emitting diode OLED and various circuit elements may be disposed in the plurality of subpixel SP. By controlling a current supplied to the organic light-emitting diode OLED by the various circuit elements, each subpixel may produce (or represent) a luminance corresponding to the image data.

Alternatively, in some cases, a light-emitting diode LED or micro light-emitting diode μLED may be disposed in the subpixel SP.

Figure 2:
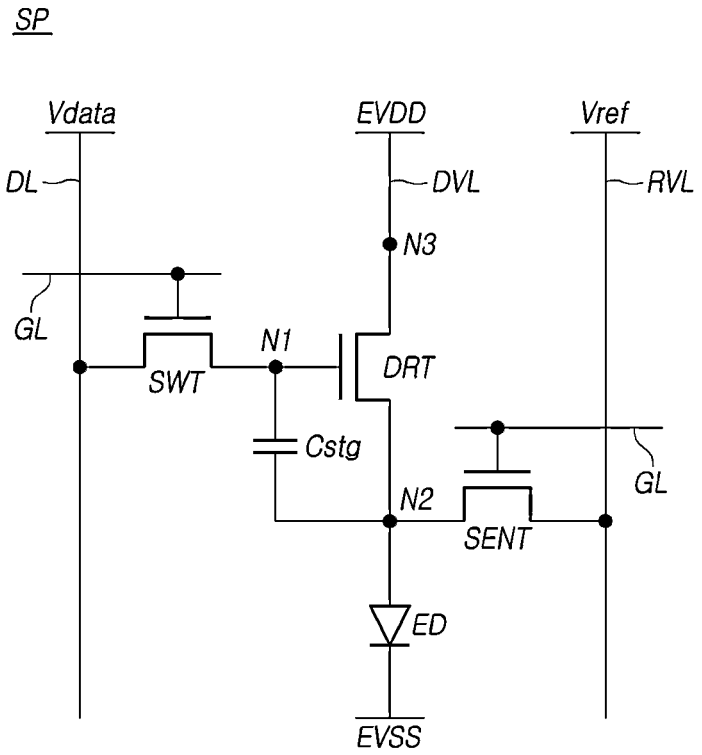
FIG. 2 is a diagram illustrating an example of a circuit structure of a subpixel included in a display device according to example embodiments of the present disclosure.

FIG. 2 is a diagram illustrating an example of a circuit structure of a subpixel SP included in the display device 100 according to example embodiments of the present disclosure.

Referring to FIG. 2, a light-emitting element ED and a driving transistor DRT for driving the light-emitting element ED may be disposed in the subpixel SP. Furthermore, at least one circuit element other than the light-emitting element ED and the driving transistor DRT may be further disposed in the subpixel SP.

For example, as illustrated in FIG. 2, a switching transistor SWT, a sensing transistor SENT and a storage capacitor Cstg may be further disposed in the subpixel SP.

An example depicted in FIG. 2 illustrates three thin film transistors and one capacitor (which may be referred to as a 3T1C structure) other than the light-emitting element ED are disposed in the subpixel SP. However, embodiments of the present disclosure are not limited to this. Furthermore, the example depicted in FIG. 2 illustrates that all of the thin film transistors are an N type, but in some cases, the thin film transistor disposed in a subpixel SP may be a P type.

Still referring to FIG. 2, the switching transistor SWT may be electrically connected between the data line DL and a first node N1. The data voltage Vdata may be supplied to the subpixel SP through the data line DL. The first node N1 may be a gate node of the driving transistor DRT.

The switching transistor SWT may be controlled by a scan signal supplied to the gate line GL. The switching transistor SWT may provide a control so that the data voltage Vdata supplied through the data line DL is applied to the gate node of the driving transistor DRT.

The driving transistor DRT may be electrically connected between a driving voltage line DVL and the light-emitting element ED.

A second node N2 of the driving transistor DRT may be electrically connected to the light-emitting element ED. The second node N2 may be a source node or a drain node of the driving transistor DRT.

A third node N3 of the driving transistor DRT may be electrically connected to the driving voltage line DVL. The third node N3 may be the drain node or the source node of the driving transistor DRT. A first driving voltage EVDD may be supplied to the third node N3 of the driving transistor DRT through the driving voltage line DVL. The first driving voltage EVDD may be a high potential driving voltage.

The driving transistor DRT may be controlled by a voltage applied to the first node N1. The driving transistor DRT may control a driving current supplied to the light-emitting element ED.

The sensing transistor SENT may be electrically connected between a reference voltage line RVL and the second node N2. A reference voltage Vref may be supplied to the second node N2 through the reference voltage line RVL.

The sensing transistor SENT may be controlled by the scan signal supplied to the gate line GL. The gate line GL controlling the sensing transistor SENT may be identical to or different from the gate line GL controlling the switching transistor SWT.

The sensing transistor SENT may provide a control so that the reference voltage Vref is applied to the second node N2. Furthermore, the sensing transistor SENT, in some cases, may provide a control so that a voltage of the second node N2 is sensed through the reference voltage line RVL.

The storage capacitor Cstg may be electrically connected between the first node N1 and the second node N2. The storage capacitor Cstg may maintain the data voltage Vdata applied to the first node N1 during one frame.

The light-emitting element ED may be electrically connected between the second node N2 and a line that a second driving voltage EVSS is supplied. The second driving voltage EVSS may be a low potential driving voltage.

The light-emitting element ED may produce (or represent) a luminance according to the driving current supplied through the driving transistor DRT.

In this respect, each subpixel SP may display an image where the light-emitting element ED produces (or represents) a luminance corresponding to an image data according to a driving of the circuit element included in the subpixel SP.

The luminance produced by the subpixels SP may vary (e.g., not uniform, not consistent, or different) from one another because the characteristics of the circuit elements or the light-emitting elements ED disposed in the subpixels SP may vary across different subpixels SP.

In one or more aspects, embodiments of the present disclosure may provide methods of preventing luminance variation (or deviation) due to the characteristic variation (or deviation) among subpixels SP and improving an image quality.

Figure 3:
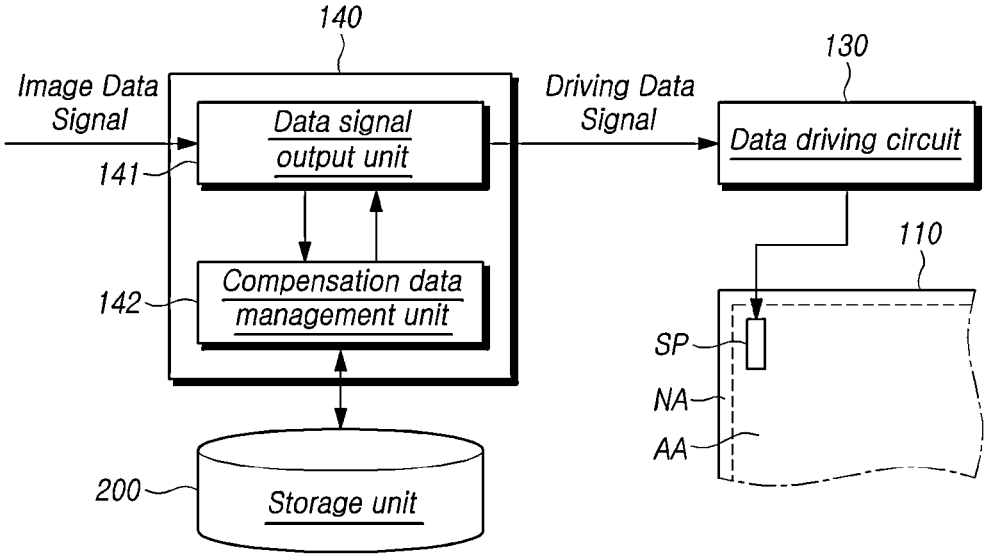
FIG. 3 is a diagram illustrating an example of a configuration and a driving scheme of a controller included in a display device according to example embodiments of the present disclosure.

FIG. 3 is a diagram illustrating an example of a configuration and a driving scheme of the controller 140 included in the display device 100 according to example embodiments of the present disclosure.

Referring to FIG. 3, the controller 140 may include a data signal output unit 141 and a compensation data management unit 142.

The data signal output unit 141 may receive an image data signal from outside. The data signal output unit 141 may output a driving data signal to the data driving circuit 130 based on the image data signal. The data driving signal may supply the data voltage Vdata according to the driving data signal and drive the subpixel SP.

The driving data signal may be a signal that a compensation data is added to the image data signal. The compensation data may be a data configured based on a characteristic variation (or deviation) of each subpixel SP.

The compensation data may be stored in a storage unit 200. The storage unit 200 may be located outside of the controller 140. Alternatively, the storage unit 200 may be located within the controller 140.

The compensation data management unit 142 may provide, to the data signal output unit 141, the compensation data which would be added to the image data signal when the data signal output unit 141 receives the image data signal from outside.

The data signal output unit 141 may generate the driving data signal by adding the compensation data provided by the compensation data management unit 142 to the image data signal and output the generated driving data signal to the data driving circuit 130.

In this regard, the compensation data according to the characteristic of a subpixel SP may be reflected in a process that the controller 140 outputs the image data signal received from outside to the data driving circuit 130. A luminance variation (or deviation) due to the characteristic variation (or deviation) among subpixels SP may be reduced, and the display panel 110 may display an image.

The compensation data for compensating the characteristic deviation between the subpixels SP may be acquired by various methods. The compensation data may be stored in the storage unit 200 as a compressed data to increase the storage efficiency.

Figure 4:
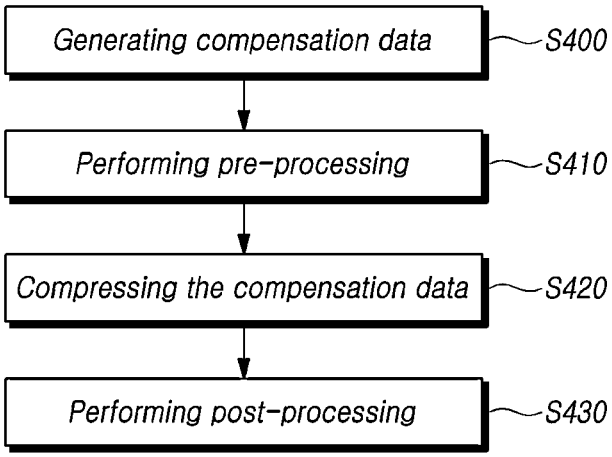
FIG. 4 is a flow chart of a method for processing a compensation data of a display device according to example embodiments of the present disclosure.

FIG. 4 is a flow chart of a method for processing a compensation data of the display device 100 according to example embodiments of the present disclosure.

Figure 5:
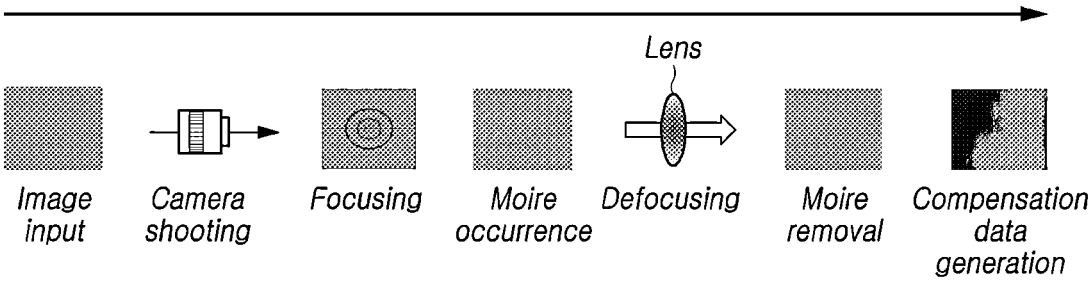
FIG. 5 is a diagram illustrating an example of a compensation data generating process in a method for processing a compensation data of a display device according to example embodiments of the present disclosure.
Figure 6:
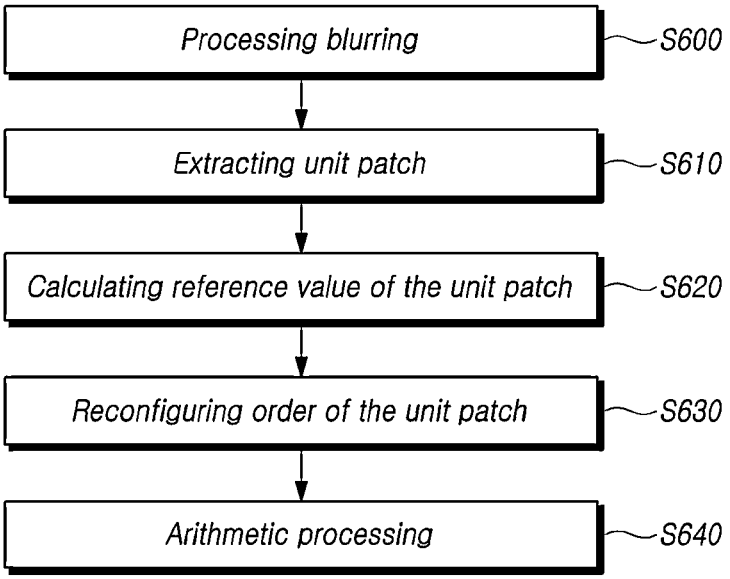
FIGS. 6 to 8 are flow charts illustrating an example of pre-processing operations in a method for processing a compensation data of a display device according to example embodiments of the present disclosure.
Figure 7:
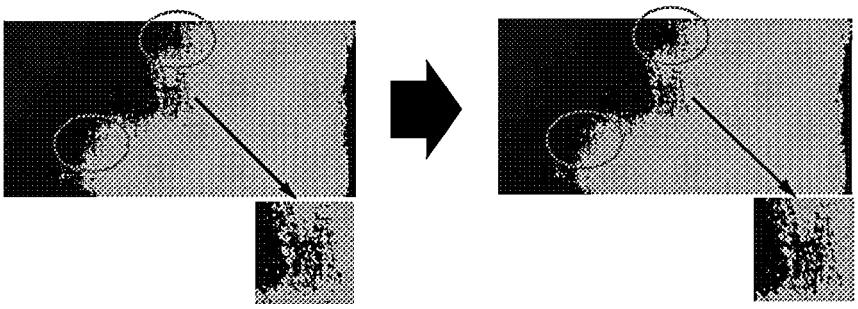
Figure 8:
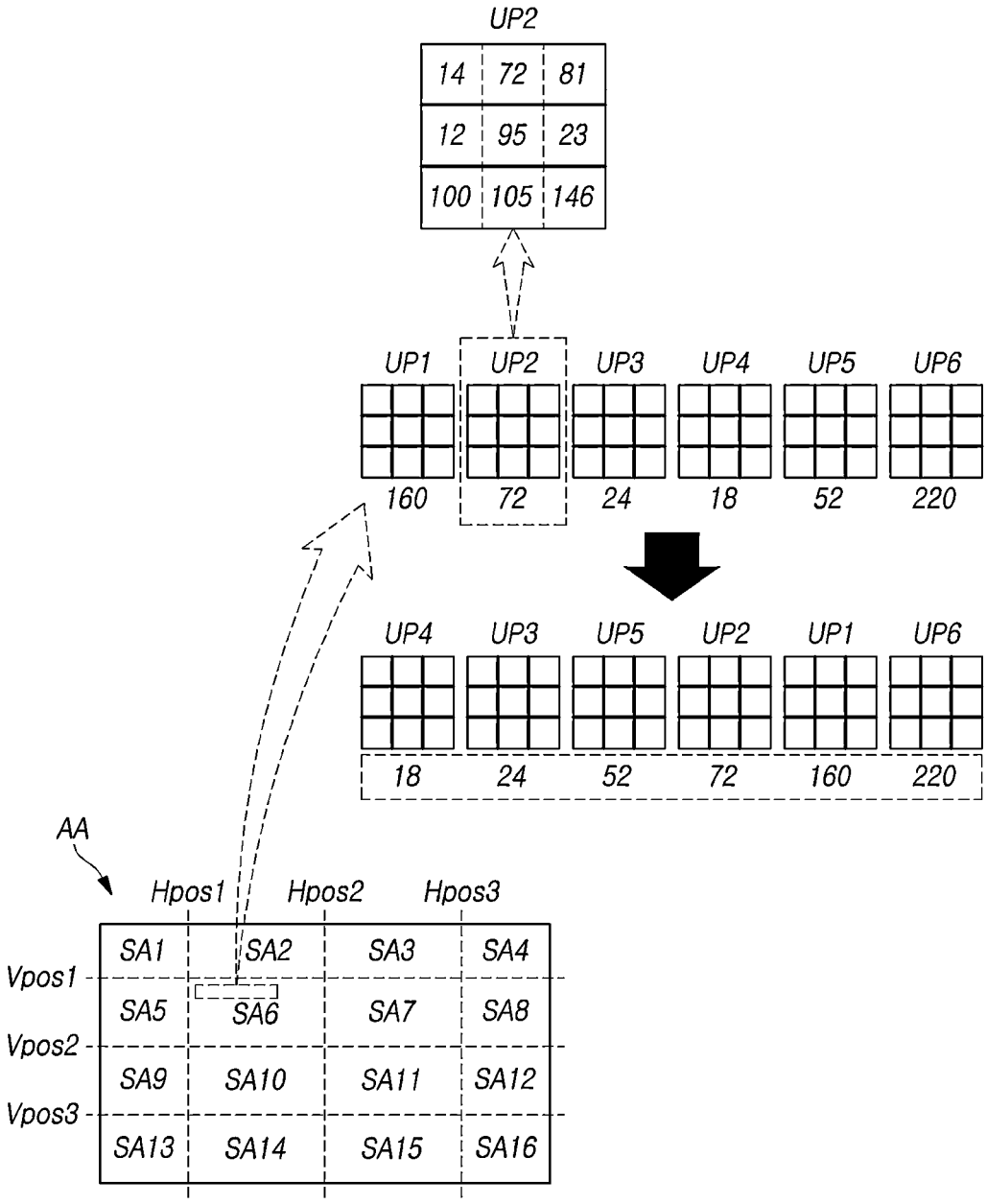
Figure 9:
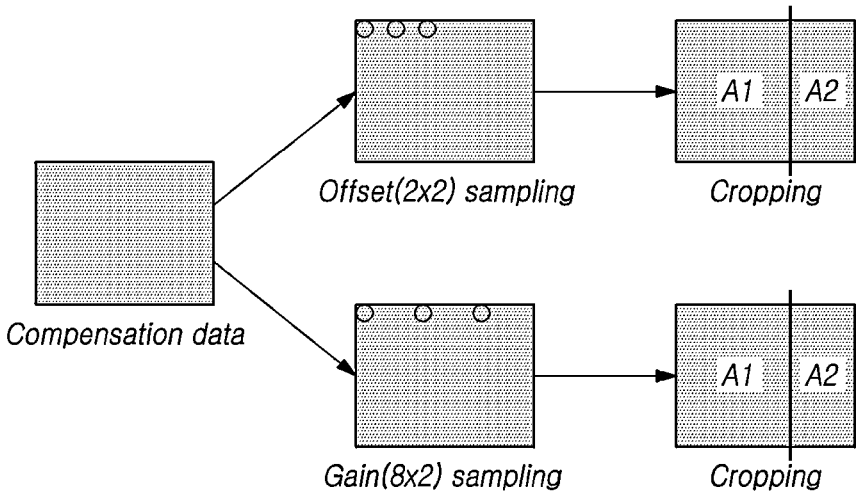
FIGS. 9 and 10 are diagrams illustrating an example of a compensation data compressing process in a method of processing a compensation data of a display device according to example embodiments of the present disclosure.
Figure 10:
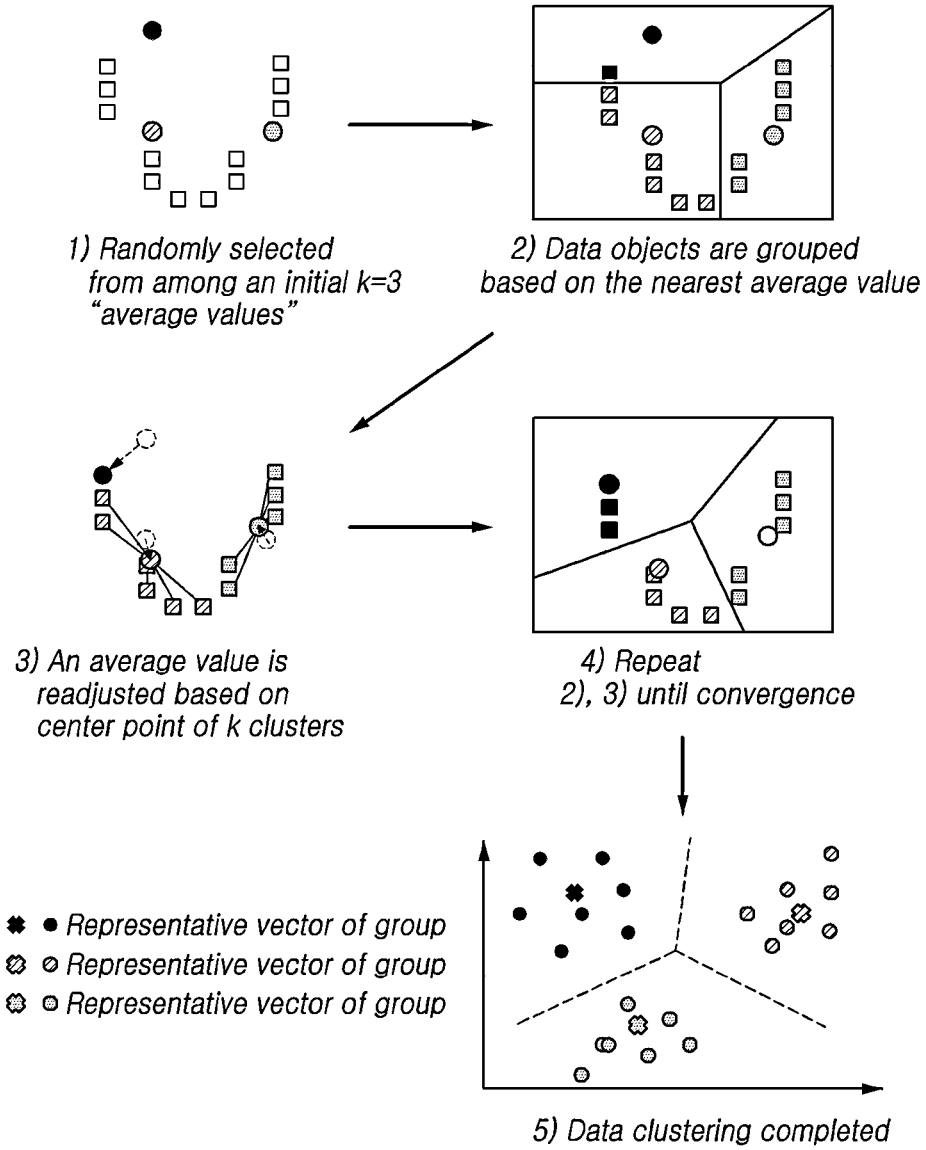

FIG. 5 is a diagram illustrating an example of a compensation data generating process in the method for processing the compensation data of the display device 100 according to example embodiments of the present disclosure. FIGS. 6 to 8 are flow charts illustrating an example of pre-processing operations in the method for processing the compensation data of the display device 100 according to example embodiments of the present disclosure. FIGS. 9 and 10 are diagrams illustrating an example of a compensation data compressing process in the method of processing the compensation data of the display device 100 according to example embodiments of the present disclosure.

Referring to FIG. 4, the compensation data for compensating the characteristic deviation between the subpixels SP may be generated at S400. The compensation data may be generated by various methods, and may be generated using an external device or internal driving of the display device 100.

When the compensation data is generated, one or more pre-processing operations for the compensation data may be performed at S410. The pre-processing operation of the compensation data may include a processing operation for increasing a compression efficiency or an accuracy of the compensation data.

The compensation data which has undergone the one or more pre-processing operations may be compressed at S420. A process of compressing the compensation data may include (or may be) a main process performed for a compression of the compensation data in an entire process in which compression processes the compensation data.

After compressing the compensation data, one or more post-processing operations may be performed at S430. In the one or more post-processing operations, an arithmetic calculation for uniformly adjusting light and shade may be applied.

The compensation data, for example, may be generated through a process that includes displaying an image by the display panel 110, measuring the image that the display panel 110 displays and correcting the measured image.

Referring to FIG. 5, when an image is displayed on the display panel 110, the image may be shot (or acquired) by an external device such as a camera.

The camera focus may be adjusted, and a process that a moire is generated on an image displayed by the display panel 110 and a process that the moire is removed may be performed.

The foregoing processes may generate the compensation data that can improve a luminance deviation in an image that the display panel 110 displays and remove the moire.

When the compensation data is generated, the pre-processing operation for an efficient compression process of the compensation data may be performed.

Referring to FIG. 6, a blurring processing for removing a noise and smoothing a boundary portion in the compensation data may be performed at S600.

When the compensation data is generated, a stain and a corner portion of an input image may have a high-frequency component having a greater value than that of a peripheral portion. The stain may mean an area where an image is not clear due to a degeneration of the subpixel SP. The high-frequency component may be smoothed and converted to a low-frequency component.

For example, as illustrated in FIG. 7, the compensation data in which a noise is removed through a Gaussian blurring and the boundary portion is smoothed may be provided.

After a blurring processing of the compensation data, two or more unit patches UP may be extracted from the active area AA at S610. The unit patch UP may include (or may be) a certain area including a plurality of compensation data in the active area AA.

A reference value of each of the two or more unit patches UP may be calculated at S620. An order of the unit patch UP may be reconfigured based on the calculated reference value at S630.

After reconfiguring the order of the unit patch UP, an arithmetic process for matching the contrast evenly may be performed at S640.

By reconfiguring the order of the unit patch UP in the pre-processing operation, a processing efficiency can be improved in a process that compresses the compensation data which is performed after the pre-processing operation.

Referring to FIG. 8, the active area AA of the display panel 110 may be divided into a plurality of sub-areas SA.

A sub-area SA may be divided by at least one vertical boundary Hpos1, Hpos2, or Hpos3 and at least one horizontal boundary Vpos1, Vpos2, or Vpos3. The sub-area SA may include (or may be) an area where the compensation data has a similar compression efficiency or where information used in a compression or a restoration process is shared. FIG. 8 illustrates an example in which the active area AA is divided into 16 sub-areas SA, but the number of the sub-areas SA may vary and is not limited to this example.

A plurality of subpixels SP may be disposed in each sub-area SA, and the compensation data for the plurality of subpixels SP may be present in each sub-area SA.

Two or more unit patches UP may be extracted from a sub-area SA (e.g., from any one of the sub-areas SA or from one or more of the sub-areas SA).

The unit patch UP may include (or may be) an area including two or more compensation data. The unit patch UP may be an N×N type (or may have an N×N structure), where N is a positive integer. FIG. 8 illustrates an example in which the unit patch UP is a 3×3 type. In one or more examples, a unit patch UP of an N×N type may include (or may be formed of or may be associated with or may represent) N×N subpixels SP. In one example, a unit patch UP of a 3×3 type may include (or may be formed of or may be associated with or may represent) 3×3 subpixels SP (e.g., 9 subpixels SP where each of the 3 rows includes 3 subpixels SP). In one or more examples, each subpixel SP may be associated with a corresponding compensation data.

Two or more unit patches UP positioned adjacent to each other, among the unit patches UP disposed in a sub-area SA, may be extracted. FIG. 8 illustrates an example in which 6 unit patches UP1, UP2, UP3, UP4, UP5, and UP6 are extracted.

The reference value of each of two or more unit patches UP can be calculated. The reference value may be a value being capable of representing a corresponding unit patch UP. For example, a reference value may be an average value of the compensation data included in the corresponding unit patch UP. Alternatively, the reference value may be a median value of the compensation data included in the corresponding unit patch UP.

For example, a second unit patch UP2 of the unit patches UP illustrated in FIG. 8 may include 9 compensation data. An average value of the 9 compensation data may be 72. Further, a median value of the 9 compensation data may be 81.

In the case of configuring the reference value of the unit patch UP as an average value of the compensation data included in the unit patch UP, the reference value of the second unit patch UP2 may be 72.

By calculating an average value of each of unit patch UP, the reference values of the 6 unit patches UP1, UP2, UP3, UP4, UP5, and UP6 may be configured.

The reference values of the 6 unit patches UP1, UP2, UP3, UP4, UP5, and UP6, for example, may be 160, 72, 24, 18, 52, and 220, respectively.

The order of the unit patch UP may be reconfigured so that the unit patches UP that have similar reference values are positioned adjacent to each other.

For example, as illustrated in FIG. 8, to arrange the unit patches UP from the smallest to the largest reference value, the unit patches UP may be rearranged as follows: a fourth unit patch UP4, a third unit patch UP3, a fifth unit patch UP5, a second unit patch UP2, a first unit patch UP1, and then a sixth unit patch UP6 in that order.

An arrangement depicted in FIG. 8 illustrates an example in which the unit patches UP are arranged in an ascending order of the reference values. In another example, the unit patches UP may be arranged in a descending order of the reference values. Furthermore, the order of the unit patch UP may be reconfigured so that, among the unit patches UP, the unit patch UP having the maximum reference value and the unit patch UP having the minimum reference value are positioned the farthest from each other.

When the order of the unit patch UP is reconfigured based on the reference value of the unit patch UP, the unit patch UP having similar reference values may be positioned adjacent to each other.

After the unit patch UP is rearranged according to the reference value, a compression process of the compensation data included in the unit patch UP may be performed, and thus a compression efficiency of the compensation data can be improved.

For example, referring to FIGS. 9 and 10, after the pre-processing of the compensation data, a process of sampling the compensation data and classifying it into two or more groups may be performed in a process of compressing the compensation data.

Referring to FIG. 9, a sampling for the compression of the compensation data may be performed. For example, the compensation data may include an offset and a gain. For example, the offset may be sampled for 2×2 subpixels SP, and the gain may be sampled for 8×2 subpixels SP.

The active area AA may be divided into a first area A1 and a second area A2 for forming a unit block for compressing after the sampling of the compensation data.

The first area A1 and the second area A2 may be divided according to the unit block utilized (or to be utilized) for compressing the compensation data.

For example, the first area A1 can be an area that the number of the compensation data included in each line (e.g., a row) can be divided by the number of the compensation data included in the unit block. The second area A2 can mean an area that the number of the compensation data included in each line (e.g., a row) is smaller than the number of the compensation data included in the unit block.

In one or more examples, the first area A1 may include (or may be) an area including one or more unit blocks, where each unit block in the first area A1 includes a first number of compensation data. Since each unit block in the first area A1 includes a first number of compensation data, each such unit block may include (or may be formed of or may be associated with or may represent) the same first number of subpixels SP. In this regard, each subpixel SP in a unit block of the first area A1 may be associated with a corresponding compensation data.

Similarly, the second area A2 may include (or may be) an area including one or more unit blocks, where each unit block in the second area A2 includes a second number of compensation data. Since each unit block in the second area A2 includes a second number of compensation data, each such unit block may include (or may be formed of or may be associated with or may represent) the same second number of subpixels SP. In this regard, each subpixel SP in a unit block of the second area A2 may be associated with a corresponding compensation data.

In one or more examples, the first number of compensation data included in a unit block obtained from the first area A1 for compression may be greater than the second number of compensation data included in a unit block obtained from the second area A2 for compression. In these examples, a unit block obtained from the first area A1 for compression may include a greater number of compensation data than that of a unit block obtained from the second area A2 for compression.

According to a resolution of the display panel 110, the first area A1 may be present only, or the first area A1 and the second area A2 may be present.

The compression processing for the compensation data included in the first area A1 may be performed through a scaling processing and a group classification process.

The compensation data included in the second area A2 may be compression-processed by a different method from the compression processing method of the compensation data included in the first area A1. For example, the compensation data included in the second area A2 may be compression-processed by a differential pulse code modulation (DPCM) method using a differential value with an adjacent compensation data.

In an operation for processing the compensation data included in the first area A1, a scaling and a group classification may be performed.

The group classification process may be performed, for example, as depicted in FIG. 10. FIG. 10 illustrates an example in which a data is classified into three groups.

The initial three average values may be selected randomly. A data object may be grouped based on the nearest average value. The average value may be readjusted based on a center point of the three groups. Above-mentioned processes may be repeated until the average value is converged to a certain value. Finally, the group classification may be terminated when the data included in the three groups and a representative value of each group are determined.

As the order of the unit patches UP is reconfigured so that the unit patches UP whose reference values are similar are positioned adjacently in the pre-processing process before performing the group classification, the group classification may be performed in a state in which similar values are positioned adjacently.

Thus, by improving a processing efficiency of the group classification, a compression loss can be reduced and a compression efficiency can be improved when the compensation data is compression-processed.

Figure 11:
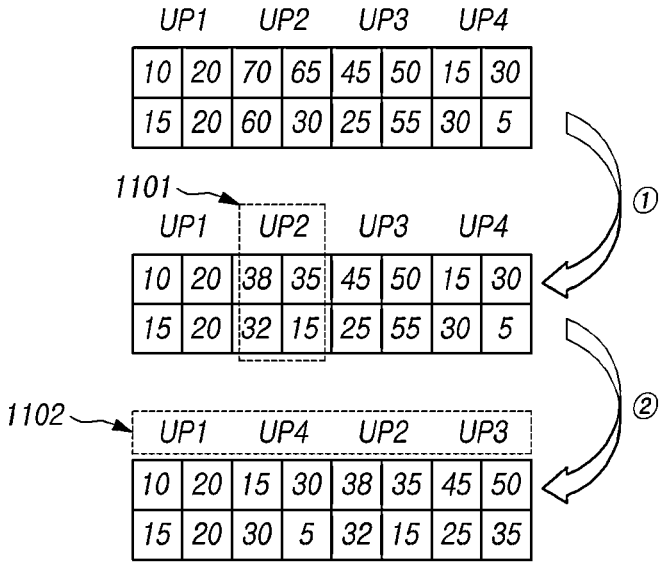
FIGS. 11 and 12 are diagrams illustrating an example of a process that pre-processes and compresses a compensation data in a method for processing a compensation data of a display device according to example embodiments of the present disclosure.
Figure 12:
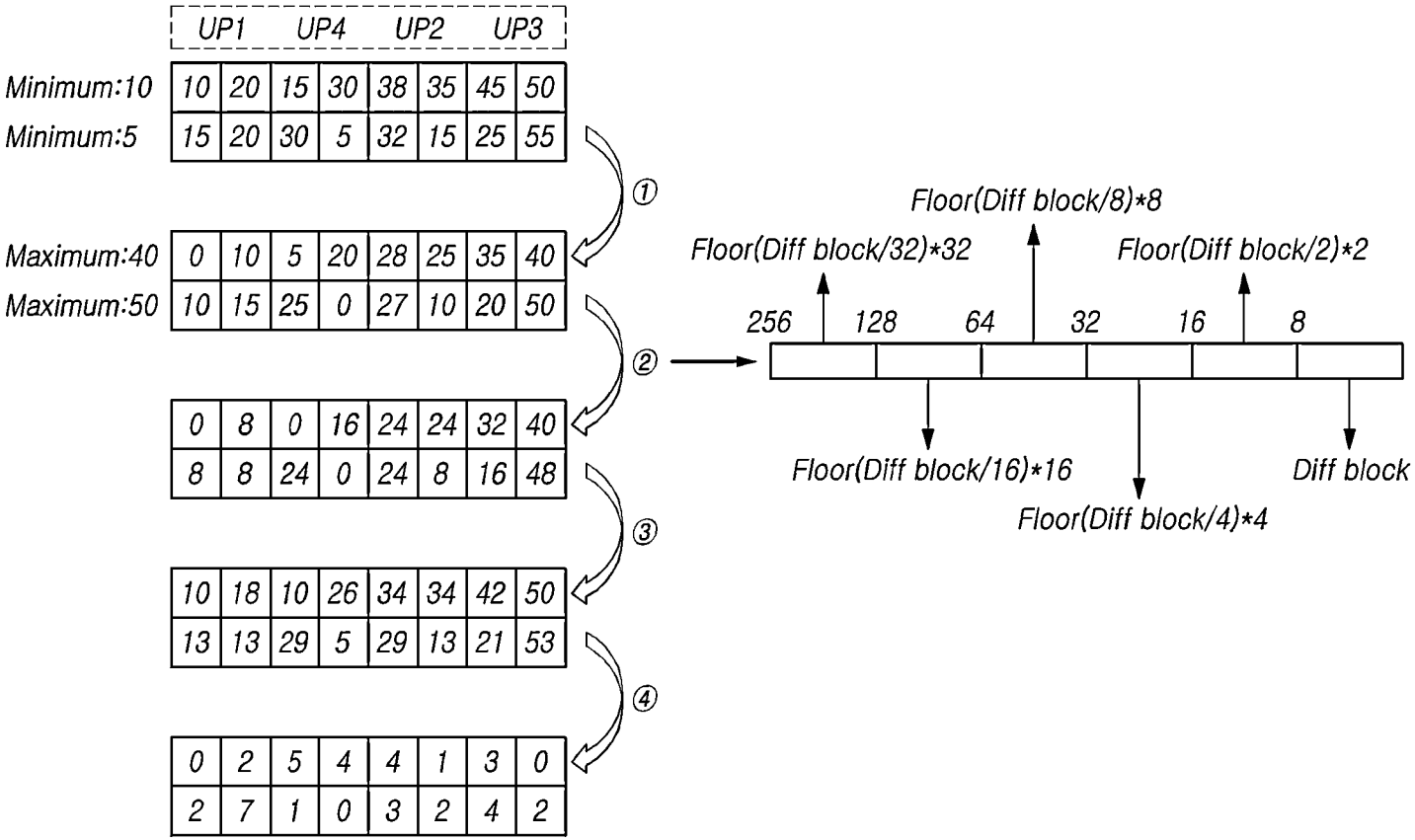

FIGS. 11 and 12 are diagrams illustrating an example of an operation that pre-processes and compresses the compensation data in a method for processing the compensation data of the display device 100 according to example embodiments of the present disclosure. FIGS. 11 and 12 illustrate an example in which the unit block that the compensation data is compressed is 1×8.

FIG. 11 illustrates one example of an operation pre-processing the compensation data in a processing method of the compensation data. FIG. 11 illustrates an example in which one unit patch UP is formed as a 2×2 type.

Four unit patches UP1, UP2, UP3, UP4 positioned adjacent to each other may be extracted from the sub-area SA in the active area AA.

A blurring processing for the compensation data included in the extracted unit patch UP may be performed at ①.

If the blurring processing is performed, for example, a difference between compensation data of adjacent subpixels SP may be reduced. Thus, such as a portion indicated by 1101, as a portion that the compensation data is great such as the second unit patch UP2 is smoothing-processed using the Gaussian filter or the like, the compensation data can be adjusted to be small.

After the blurring processing, the order of the unit patches UP may be reconfigured according to the reference value of each of unit patches UP at ②. FIG. 11 illustrates an example in which the average value of the unit patch UP is used as the reference value of the unit patch UP.

Such as a portion indicated by 1102, the unit patches UP may be rearranged in an order from the unit patch UP whose reference value is small to the unit patch UP whose reference value is great.

The unit patches UP having similar reference values may be positioned adjacent to each other.

In a state that the unit patches UP are rearranged so that the unit patches UP having similar reference values are positioned adjacent to each other, a processing for a compression of the compensation data may be performed.

Referring to FIG. 12, a scaling processing of the compensation data may be performed.

A minimum value (e.g., 10 or 5) may be extracted from each respective unit block of the compensation data. In this example, the minimum value for the top unit block is 10, and the minimum value for the bottom unit block is 5. The minimum value (e.g., 10 or 5) may be subtracted from each respective original value of the compensation data to obtain a respective differential value (Diff block) at ①. For example, the differential value Diff block may be used to reduce a size of a data used for calculating.

A second differential value may be acquired by performing a calculation according to a section that the differential value is included at ②. For example, the second differential value may be used to reduce a size of a data according to the section.

The second differential value, for example, may be calculated by the following equation.

$$\text{The second differential value} = \text{Floor}(\text{the differential value}/2^{-n})/2^{\wedge n}$$

Floor (X) may be the maximum integer not over the X.

n may be a value which is determined according to a section that the differential value is included.

For example, if the differential value is included in a section between 8 and 16, n may be 1. Thereafter, n may be 2, 3, 4, 5 according to each section.

The second differential value may be acquired from a differential value that the minimum is subtracted from the original value by the above-mentioned equation.

A revised value may be acquired by adding the minimum value to the second differential value at ③.

By calculating a difference of the revised value and the original value, an error value may be acquired at ④.

Finally, a process of classifying the acquired error value into groups may be performed.

In the pre-processing illustrated in FIG. 11, as the scaling processing is performed in a state in which the unit patches UP having similar reference values are rearranged adjacent to each other, similar error values may be positioned adjacently.

Thus, the number of performing the group classification can be reduced in the group classification process performed thereafter. As the efficiency of the compression processing of the compensation data is improved, a compression loss of the compensation data can be reduced and an effect of an image quality improvement using the compensation data can be enhanced.

Various example embodiments and aspects of the present disclosure are described below for convenience. These are provided as examples, and do not limit the subject technology. Some of the examples described below are illustrated with respect to the figures disclosed herein simply for illustration purposes without limiting the scope of the subject technology.

In one or more examples, a compensation data may include a set of compensation data. In one or more examples, a compensation data may include a plurality of compensation data. In one or more examples, a compensation data for a plurality of subpixels may include one or more compensation data. In one or more examples, a compensation data for a plurality of subpixels may include two or more compensation data. In one or more example, a subpixel may be associated with a corresponding compensation data.

In one or more examples, a host system may be a computer, a computer system, or a system with a processor.

In one or more examples, the controller 140 may include (or may be) a processor that may be configured to execute code or instructions to perform the operations and functionality described herein and to perform calculations and generate commands. In one or more examples, components of the controller 140 (e.g., a data signal output unit 141 and a compensation data management unit 142) may include (or may be) processors. The processor of the controller 140 may be configured to monitor and/or control the operation of the components in the display device 100. The processor may be, for example, a microprocessor, a microcontroller, a digital signal processor, an application specific integrated circuit, a field programmable gate array, a programmable logic device, a state machine, gated logic, discrete hardware components, or a combination of the foregoing.

One or more sequences of instructions may be stored within the controller 140 and/or the storage unit 200 (e.g., one or more memories). One or more sequences of instructions may be software or firmware stored and read from the controller 140 and/or the storage unit 200, or received from a host system. The storage unit 200 may be an example of a non-transitory computer readable medium on which instructions or code executable by the controller 140 and/or its processor may be stored. A computer readable medium may refer to a non-transitory medium used to provide instructions to the controller 140 and/or its processor. A medium may include one or more media. A processor may include one or more processors or one or more sub-processors. A processor of the controller 140 may be configured to execute code, may be programmed to execute code, or may be operable to execute code, where such code may be stored in the controller 140 and/or the storage unit 200.

In one or more examples, the controller 140 (or its processor or components thereof) may perform, or may cause performing, the methods (e.g., the processes, steps, and operations) described with respect to various figures, such as FIGS. 3-12. For example, the controller 140 (or its processor or components thereof) may perform, or may cause performing, the methods (e.g., the processes, steps, and operations) described herein or describe below.

For example, the controller 140 (or its processor or components thereof) may perform, or may cause performing any or all of the following: generating a compensation data; extracting two or more unit patches; calculating reference values; reconfiguring an order of the two or more unit patches; compressing the compensation data; calculating an average value or a median value of the compensation data; reconfiguring the order of the two or more unit patches in an ascending or descending order of the reference values; reconfiguring the order of the two or more unit patches so that, among the two or more unit patches, a unit patch whose reference value is the greatest and a unit patch whose reference value is the smallest are positioned the farthest from each other; extracting the two or more unit patches that are positioned adjacent to each other among a plurality of unit patches included in a sub-area of a plurality of sub-areas; blurring the compensation data for the plurality of subpixels; scaling the compensation data; classifying the scaled compensation data into two or more groups; dividing the active area into a first area and a second area; scaling the compensation data acquired from the first area, and classifying the scaled compensation data into two or more groups; compressing the compensation data acquired from a first area; and compressing the compensation data acquired from a second area.

A method for processing a compensation data of a display device 100 according to example embodiments of the present disclosure may include generating a compensation data for a plurality of subpixels SP disposed in an active area AA of a display panel 110, extracting two or more unit patches UP from the active area AA, calculating a reference value of each of the two or more unit patches UP using the compensation data included in each of the two or more unit patches UP, reconfiguring an order of the two or more unit patches UP based on the reference value, and compressing the compensation data included in the two or more unit patches UP that are positioned (or disposed or arranged) according to an order which is reconfigured (e.g., according to the reconfigured order).

The calculating the reference value of each of the two or more unit patches UP may include calculating an average value or a median value of the compensation data included in each of the two or more unit patches UP as the reference value.

The reconfiguring the order of the two or more unit patches UP can include reconfiguring the order of the two or more unit patches UP so that the two or more unit patches UP are positioned in an ascending order of the reference values.

Alternatively, the reconfiguring the order of the two or more unit patches UP can include reconfiguring the order of the two or more unit patches UP so that the two or more unit patches UP are positioned in a descending order of the reference values.

Furthermore, the reconfiguring the order of the two or more unit patches UP may include reconfiguring the order of the two or more unit patches UP so that, among the two or more unit patches UP, a unit patch UP whose reference value is the greatest and a unit patch UP whose reference value is the least are positioned the farthest from each other.

The extracting the two or more unit patches UP may include extracting the two or more unit patches UP that are positioned adjacent to each other among a plurality of unit patches UP included in any one sub-area SA of a plurality of sub-areas SA, which are included in the active area AA.

Sizes of at least two sub-areas SA of the plurality of sub-areas SA may be different from each other.

The extracting the two or more unit patches UP may include blurring the compensation data for the plurality of subpixels SP, and extracting the two or more unit patches UP.

The compressing the compensation data may include scaling the compensation data, and classifying the scaled compensation data into two or more groups.

The classifying the scaled compensation data into the two or more groups may be performed repeatedly at least two or more times.

The compressing the compensation data may include dividing the active area AA into a first area A1 and a second area A2, and scaling the compensation data acquired from the first area A1 and classifying the scaled compensation data into two or more groups.

A method for compressing the compensation data acquired from the second area A2 may be different from a method for compressing the compensation data acquired from the first area A1.

The number of the compensation data included in a unit block acquired from the first area A1 and compressed may be greater than the number of the compensation data included in a unit block acquired from the second area A2 and compressed.

A display device 100 according to example embodiments of the present disclosure may include a plurality of subpixels SP disposed in an active area AA of a display panel 110, a data driving circuit 130 configured to drive the plurality of subpixels SP, and a controller 140 configured to control the data driving circuit 130 and store a compensation data for the plurality of subpixels SP. The controller may be configured to cause: storing the compensation data by extracting two or more unit patches UP from the active area AA; reconfiguring an order of the two or more unit patches UP according to a reference value determined by using the compensation data included in each of the two or more unit patches UP; and compressing the compensation data included in the two or more unit patches UP that are arranged (or disposed or positioned) according to the reconfigured order.

The controller 140 may be configured to cause: restoring the compressed compensation data; generating a driving data signal by adding the restored compensation data to an image data signal corresponding to the plurality of subpixels SP; and outputting the driving data signal to the data driving circuit 130.

The above description has been presented to enable any person skilled in the art to make, use and practice the technical features of the present disclosure, and has been provided in the context of a particular application and its requirements as examples. Various modifications, additions and substitutions to the described embodiments will be readily apparent to those skilled in the art, and the principles described herein may be applied to other embodiments and applications without departing from the scope of the present disclosure. The above description and the accompanying drawings provide examples of the technical features of the present invention for illustrative purposes. In other words, the disclosed embodiments are intended to illustrate the scope of the technical features of the present disclosure. Thus, the scope of the present disclosure is not limited to the embodiments shown, but is to be accorded the widest scope consistent with the claims. The scope of protection of the present disclosure should be construed based on the following claims, and all technical features within the scope of equivalents thereof should be construed as being included within the scope of the present disclosure.

What is claimed is:

1. A method for processing a compensation data of a display device, the method comprising:

generating a compensation data for a plurality of subpixels disposed in an active area of a display panel;

extracting two or more unit patches from the active area;

calculating a reference value of each of the two or more unit patches using the compensation data included in each of the two or more unit patches;

reconfiguring an order of the two or more unit patches based on the reference value; and compressing the compensation data included in the two or more unit patches that are positioned according to the reconfigured order, wherein the compressing the compensation data comprises:

dividing the active area into a first area and a second area; and scaling the compensation data acquired from the first area, and classifying the scaled compensation data into two or more groups.

2. The method for processing the compensation data of the display device of claim 1, wherein the calculating the reference value of each of the two or more unit patches comprises:

calculating an average value or a median value of the compensation data included in each of the two or more unit patches as the reference value.

3. The method for processing the compensation data of the display device of claim 1, wherein the reconfiguring the order of the two or more unit patches comprises:

reconfiguring the order of the two or more unit patches so that the two or more unit patches are positioned in an ascending order of the reference values.

4. The method for processing the compensation data of the display device of claim 1, wherein the reconfiguring the order of the two or more unit patches comprises:

reconfiguring the order of the two or more unit patches so that the two or more unit patches are positioned in a descending order of the reference values.

5. The method for processing the compensation data of the display device of claim 1, wherein the reconfiguring the order of the two or more unit patches comprises:

reconfiguring the order of the two or more unit patches so that, among the two or more unit patches, a unit patch whose reference value is the greatest and a unit patch whose reference value is the smallest are positioned the farthest from each other.

6. The method for processing the compensation data of the display device of claim 1, wherein the extracting the two or more unit patches comprises:

extracting the two or more unit patches that are positioned adjacent to each other among a plurality of unit patches included in a sub-area of a plurality of sub-areas, wherein the plurality of sub-areas are included in the active area.

7. The method for processing the compensation data of the display device of claim 6, wherein sizes of at least two sub-areas of the plurality of sub-areas are different from each other.

8. The method for processing the compensation data of the display device of claim 1, wherein the extracting the two or more unit patches comprises:

blurring the compensation data for the plurality of subpixels, and extracting the two or more unit patches.

9. The method for processing the compensation data of the display device of claim 1, wherein the compressing the compensation data comprises:

scaling the compensation data; and classifying the scaled compensation data into two or more groups.

10. The method for processing the compensation data of the display device of claim 9, wherein the classifying the scaled compensation data into the two or more groups is performed repeatedly at least two or more times.

11. The method for processing the compensation data of the display device of claim 1, wherein a method for compressing the compensation data acquired from the second area is different from a method for compressing the compensation data acquired from the first area.

12. The method for processing the compensation data of the display device of claim 1, wherein the number of the compensation data included in a unit block acquired from the first area and compressed is greater than the number of the compensation data included in a unit block acquired from the second area and compressed.

13. A display device, comprising:

a plurality of subpixels disposed in an active area of a display panel;

a data driving circuit configured to drive the plurality of subpixels; and a controller configured to control the data driving circuit and store a compensation data for the plurality of subpixels, wherein the controller is configured to cause:

storing the compensation data by extracting two or more unit patches from the active area;

reconfiguring an order of the two or more unit patches according to a reference value determined by using the compensation data included in each of the two or more unit patches; and compressing the compensation data included in the two or more unit patches that are arranged according to the reconfigured order, and wherein the compressing the compensation data comprises:

dividing the active area into a first area and a second area; and scaling the compensation data acquired from the first area, and classifying the scaled compensation data into two or more groups.

14. The display device of claim 13, wherein the controller is configured to cause:

restoring the compressed compensation data;

generating a driving data signal by adding the restored compensation data to an image data signal corresponding to the plurality of subpixels; and outputting the driving data signal to the data driving circuit.

* * * * *